United States Patent [19]

Berger et al.

[11] Patent Number: 4,669,055

[45] Date of Patent: May 26, 1987

[54] NON-RECURSIVE ANALOG INTEGRATOR

[75] Inventors: Jean Luc Berger, Grenoble; Jean Louis Coutures, Boulogne Billancourt, both of France

[73] Assignee: Thomson-CSF, Paris, France

[21] Appl. No.: 705,559

[22] Filed: Feb. 26, 1985

[30] Foreign Application Priority Data

Mar. 5, 1984 [FR] France ..... 84 03356

[51] Int. Cl.[4] ..... G06G 7/184

[52] U.S. Cl. ..... 364/829; 364/605; 364/830; 364/862

[58] Field of Search ..... 364/800, 807, 825, 829–832, 364/861–862, 602, 605; 333/165–166

[56] References Cited

U.S. PATENT DOCUMENTS

| | | | |
|---|---|---|---|
| 4,031,380 | 6/1977 | Audaire et al. | 364/829 X |
| 4,264,983 | 4/1981 | Miller | 364/825 |
| 4,267,580 | 5/1981 | Bond et al. | 364/862 X |
| 4,514,821 | 4/1985 | Tower | 364/862 |
| 4,524,424 | 6/1985 | White | 333/166 X |

OTHER PUBLICATIONS

IEEE Journal of Solid-State Circuits, vol. SC-13, No. 1, Feb. 1978, IEEE, New York (US), E. F. Barbe et al.: "Signal Processing . . .", pp. 34–51.

IEEE Transactions on Electron Device, vol. ED-26, No. 4, Apr. 1979, IEEE, New York (US), D. A. Gandolfo et al.: "Analog-binary . . .", pp. 596–603.

IEEE Journal of Solid-State Circuits, vol. SC-14, No. 4, Aug. 1978, IEEE, New York (US), C. P. Traynar et al.: "A Nonrecursive Signal . . . ", pp. 742–746.

*Primary Examiner*—Gary V. Harkcom

*Attorney, Agent, or Firm*—Roland Plottel

[57] ABSTRACT

A non recursive analog integrator providing M integrations of a sampled analog signal Vn,m. The integrator comprises a series parallel demultiplexer with N outputs, N capacitors each with an electrode connected to a floating potential with respect to a reference potential, and a parallel series multiplexer with N inputs, the respective capacitors being connected in parallel between the outputs of the demultiplexer and the inputs of the multiplexer. Each capacitor performs, at each integration, the summation in form of charges of the sample of corresponding rank of the sampled analog signal Vn,m. So, at the end of the M integrations, an analog signal- $$\sum_{m=1,m} Vn,m$$

is obtained at the output of the multiplexer. Charge transfer devices serve as the series parallel demultiplexer and as the parallel series multiplexer.

12 Claims, 12 Drawing Figures

FIG_6-a
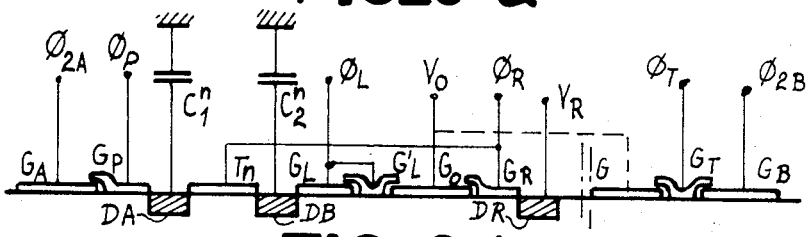
FIG_6-b
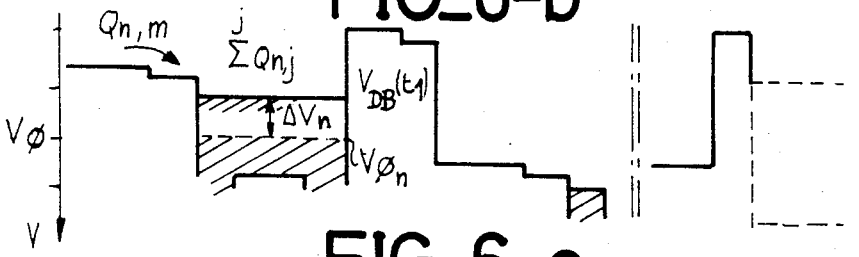
FIG_6-c
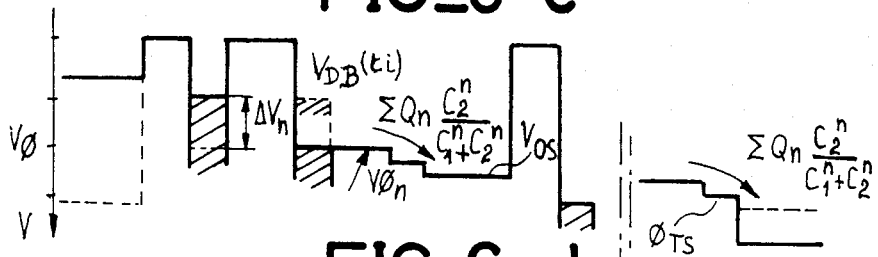
FIG_6-d
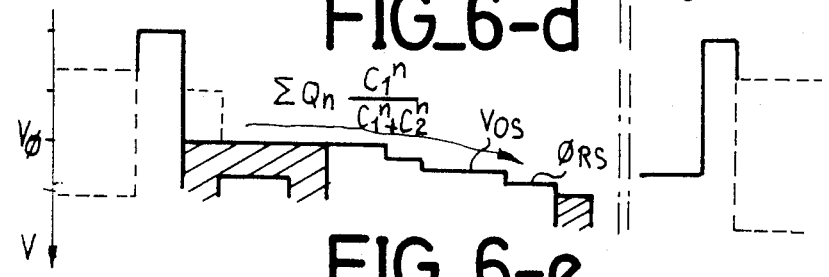
FIG_6-e
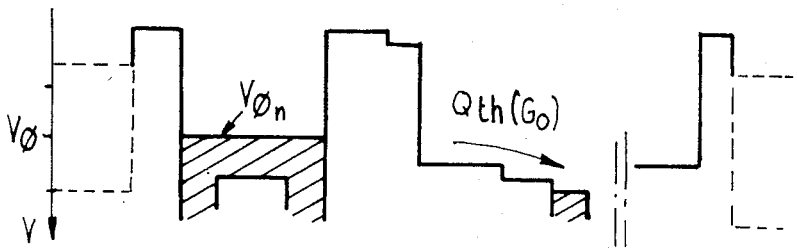

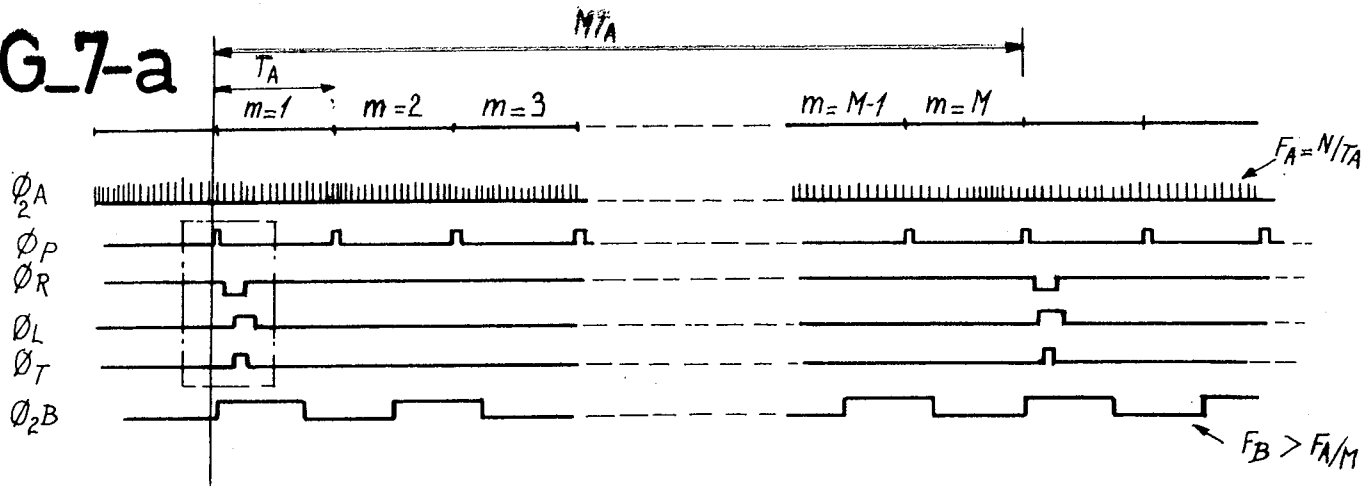
FIG_7-a
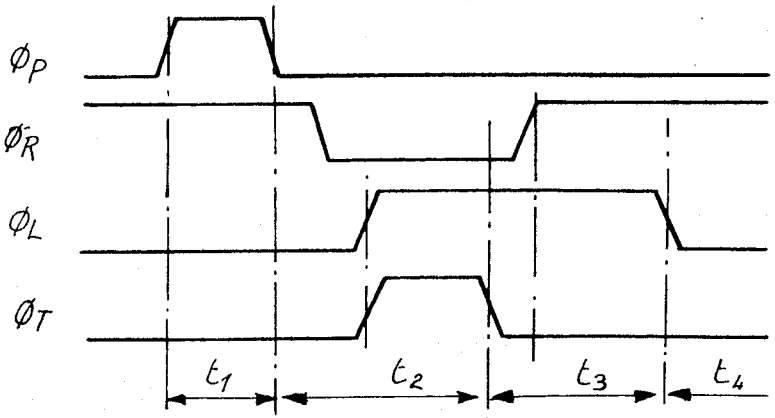
FIG_7-b

NON-RECURSIVE ANALOG INTEGRATOR

BACKGROUND OF THE INVENTION

1. Field of the Invention

The present invention relates to a non recursive analog integrator, more especially an integrator using the charge transfer for integrating an analog signal sampled over M sequences.

Integrators are generally used for processing analog signals which may be defined as a repetitive and slowly varying sequence, either for reducing the energy of the signal transmitted or for removing noise from the signal received. In fact, integration of these repetitive sequences improves the signal/noise ratio by a factor $\sqrt{M}$ if the integration takes place over M sequences. Thus, integrators may for example be used for detecting the spectral lines of a recurrent spectrum at the output of an acoustic surface wave analyzer.

2. Description of the Prior Art

The integrators used for this type of processing may be digital or analog, recursive or non recursive integrators.

Digital integrators have the drawback of requiring a very long processing time. Furthermore, the analog sampling frequency and the dynamics are limited by the input analog-digital converter.

There also exist different types of recursive or non recursive analog integrators using charge transfer devices.

As shown schematically in FIG. 1, recursive analog integrators are generally formed by a charge transfer shift register 1 whose output signal S is relooped back to the input signal E to which it is added in the summator Σ. However, because of the deterioration of integration due to transfer inefficiency in the charge transfer register 1, the relooping number is limited. Moreover, the heat generation of charges in register 1 causes rapid saturation of the register and is a factor of instability in the loop.

As shown in FIG. 2, a non recursive analog integrator is formed essentially by N charge transfer shift registers $R_1, R_2 \ldots R_N$, with a series input and parallel output, each register comprising M stages for integrating the M samples of rank n (n varying between 1 and N) of the input signal, the N registers $R_1, R_2 \ldots R_N$ being connected between an input addressing register $R_A$ and output addressing register $R_B$ successively addressing, by switching analog gates $G_1, \ldots G_N$ and $G'_1, \ldots G'_N$, the inputs or the outputs of the N shift registers $R_1, R_2, \ldots R_N$ for inputting first of all into the shift registers $R_1, R_2, \ldots R_N$ M times the sampled input signal E then for extracting an analog signal S corresponding to the sum of the inputted signals. However, the heat generation in shift registers of the charge transfer type limits the integration time.

SUMMARY OF THE INVENTION

The aim of the present invention is to overcome these disadvantages by proposing a non recursive analog integrator in which the heat generation at the integration sites is relatively small, which allows a high integration time.

The present invention therefore provides a non recursive analog integrator integrating a sampled analog signal $V_{n,m}$ over M sequences, comprising a series-parallel input demultiplexer for successively applying M times the sampled analog signal to N storage means connected in parallel to the input demultiplexer, each storage means providing summation in the form of charges, for the M sequences, of the sample of a rank corresponding to the analog signal of $V_{n,m}$ and further comprising a parallel-series output multiplexer connected to the N storage means for outputting, at the end of the M sequences, an analog signal $\Sigma_{m=1,M}V_{n,m}$.

In a preferred embodiment, the storage means are formed by capacitors with floating potential with respect to a reference potential, the input demultiplexer is formed by a charge transfer shift register or CCD register (charge coupled device) with series input and parallel outputs and the output multiplexer by a CCD register with parallel inputs and a series output. The use of two CCD registers as input demultiplexer and output multiplexer allows a high operating frequency to be provided for the integrator. In fact, the transfer of charges inside the output register to the reading stage takes place during at least a part of the following integration cycle. Furthermore, the transfer frequency in the output register may be relatively slow with respect to the transfer frequency in the input register. In fact, the relation between these two frequencies should be $$F_B \geqq (1/M)F_A$$

in which:

$F_B$ is the transfer frequency of the output register, $F_A$ is the transfer frequency of the input register, and M is the number of sequences.

Furthermore, since the charge which may be transferred by a CCD type shift register is limited ($\approx 10^7$ electrons), the storage means or integration sites are preferably each formed by two floating potential MOS capacitors interconnected by an analog gate with, in addition, between the capacitors and the output shift register a routing device for sending the charges either to the output shift register or to a charge removal means.

In another embodiment, the output multiplexer may be formed by analog gates connected respectively between each storage means and the reading stage, said gates being controlled successively by a pulse provided by an addressing register. In this case, however, reading of all the storage means must be carried out before the next integration begins at the level of said storage means.

BRIEF DESCRIPTION OF THE DRAWINGS

Other features and advantages of the present invention will be clear from the following description of different embodiments of non recursive analog integrators of the invention with reference to the accompanying drawings in which:

FIGS. 6*a* to 6*e* are respectively a schematical sectional view through VI—VI of FIG. 5 and diagrams showing the evolution of the surface potential as a function of time.

FIGS. 7*a* and 7*b* are diagrams of the different control voltages applied to the integrator of FIG. 5.

In the figures, the same elements bear the same references. However, for the sake of clarity, the sizes and proportions of the different elements have not been respected.

DESCRIPTION OF THE PREFERRED EMBODIMENT

Figure 1:
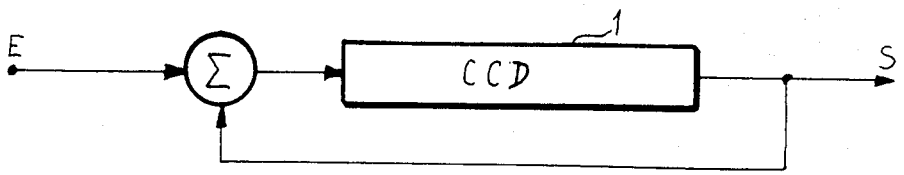
FIG 1 PRIOR ART
FIG. 1, already described, is a schematical view of a recursive analog integrator of the prior art, FIG. 2, already described, is a schematical view of a non recursive analog integrator of the prior art.
Figure 2:
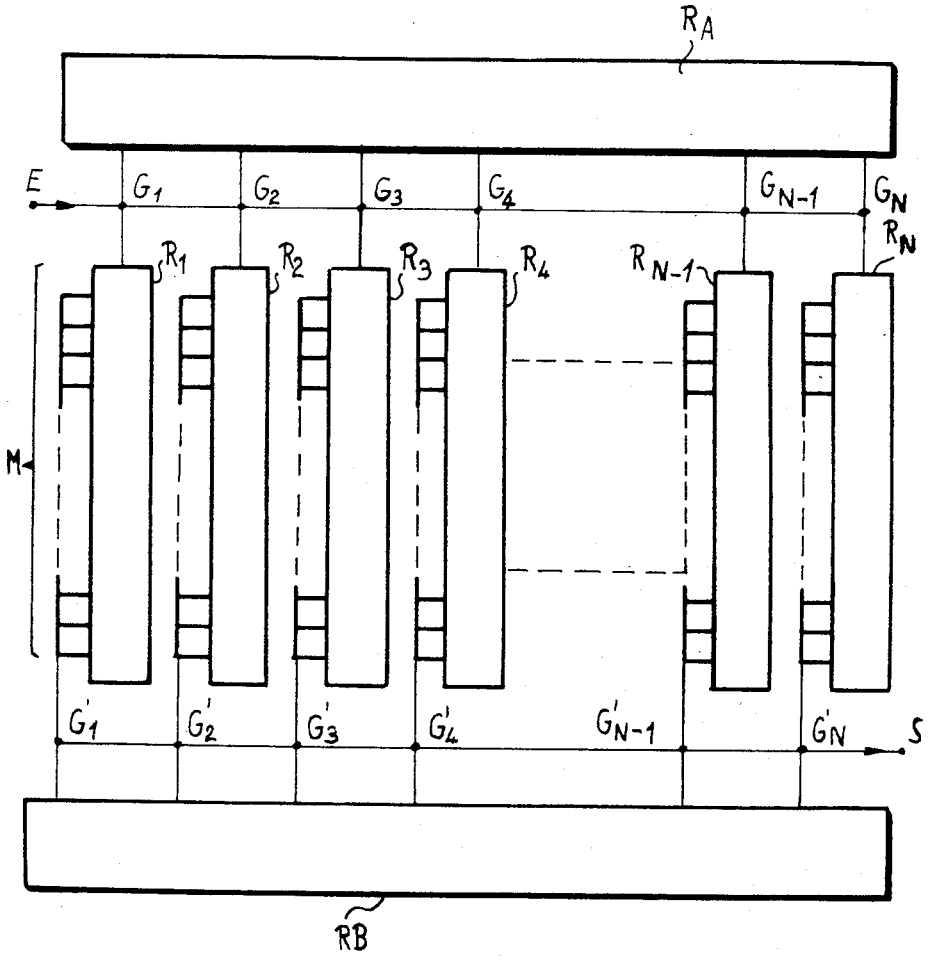
FIG 2 PRIOR ART
Figure 3:
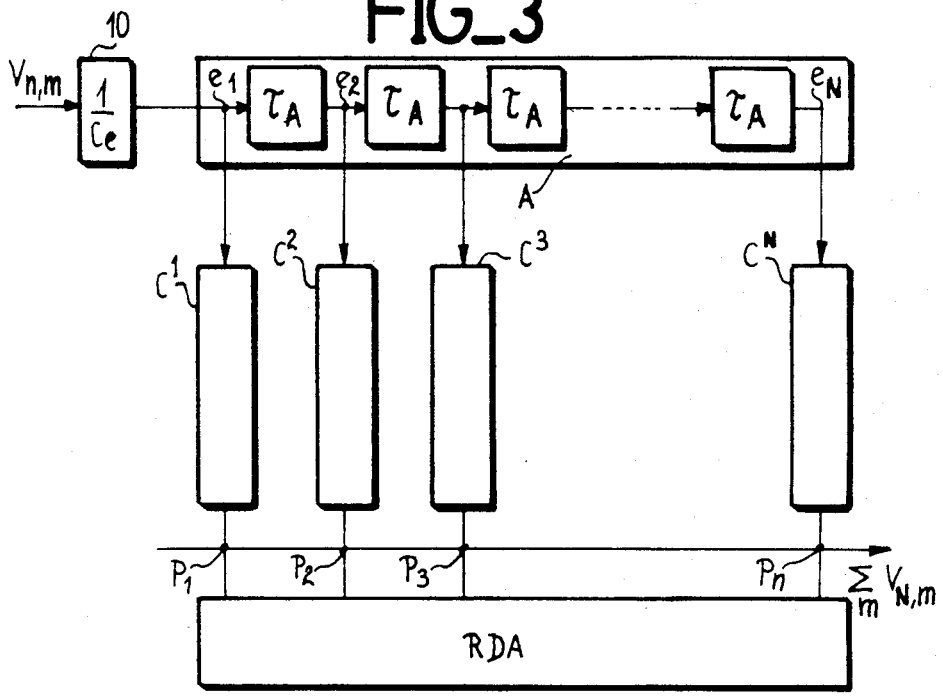
FIG. 3 is a schematical view of a non recursive analog integrator in accordance with the present invention.
Figure 4:
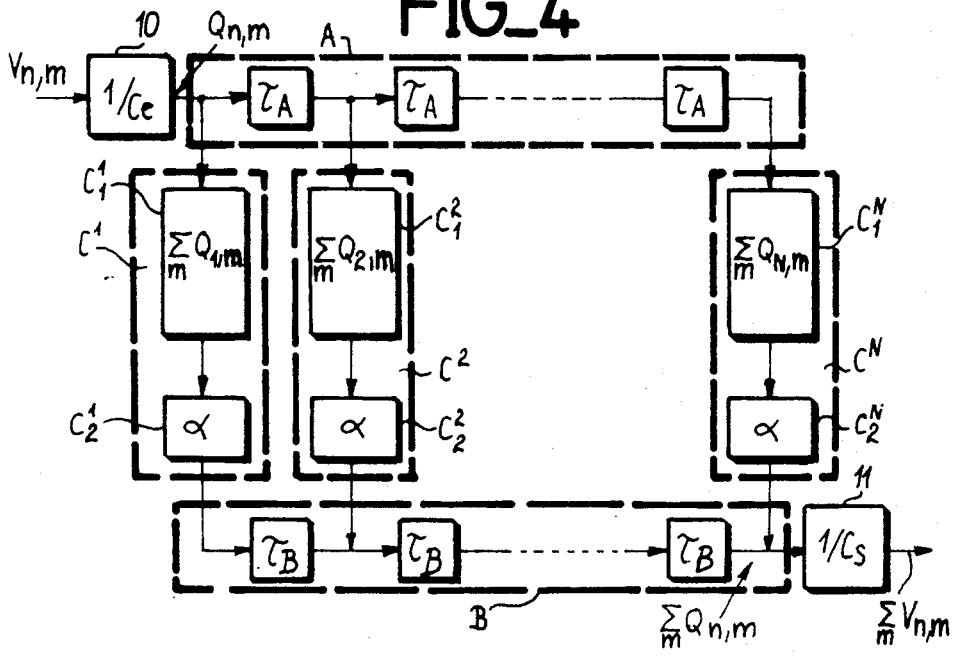
FIG. 4 is a schematical view of another embodiment of a non recursive analog integrator according to the present invention.

FIGS. 3 and 4 are general diagrams of two embodiments of a non recursive analog integrator in accordance with the present invention. The integrators described herebelow provide integration over M sequences, the resolution of each sequence being over N points for a time $T_A$ thus giving a sampled input analog signal $V_{n,m}$ with m=rank of the sequence n=rank of the sample in the sequence, $1 \leqq n \leqq N$.

The integrator of FIG. 3 comprises first of all a voltage-charge conversion stage 10 having a capacity $1/C_e$ and transforming the sampled analog signal $V_{n,m}$ into a charge packet $Q_{n,m}$. Stage 10 is followed by a charge transfer shift register A which receives the N charge packets corresponding to the N samples of a sequence. Register A is formed by a series of N transfer stages $e_1$ to $e_N$ each introducing the same delay $\tau_A$ which is given by the period of the potential applied to the electrodes providing the charge transfer.

The delay $\tau_A$ is chosen so that:

$$N\tau A = T_A = \text{the time of an input sequence.}$$

After each time $T_A$ there is obtained at the output of each stage of rank n (with $1 \leqq n \leqq N$) a charge amount $Q_{n,m}$ correponding to the sample rank n of the input sequence considered. In FIG. 3, only the outputs of the N stages have been shown and the squares referenced $\tau$ A symbolize the delay between the different stages.

In accordance with the present invention, the output of each stage of the shift register A is connected to charge storage means formed by floating potential capacitors $C^1, C^2, \ldots C^N$, the operation of which will be described in more detail herebelow. Each capacitor $C^1, C^2, \ldots C^N$ performs, for the whole of the M sequences, summation of the charges at the output of the corresponding stage of register A. Thus, at the end of the M sequences, i.e. after a time MTA corresponding to an integration cycle, each capacity $C^n$ of rank n (with n varying from 1 to N) contains a charge amount $$Q_{In} = \sum_m Q_{n,m}.$$

The storage capacitors are connected to a single reading stage through analog gates $P_1, P_2, \ldots P_N$ whose closure is controlled by an addressing register RDA which cyclically feeds, at the end of an integration cycle, a logic level "b 1" to each output, the other outputs being at that time at the logic level "0". That allows the charge amounts $$\sum_m Q_{n,m}$$

integrated in each capacity $C^1, C^2, \ldots C^N$ to be read successively and a sampled signal $\Sigma_m V_{n,m}$ to be obtained at the output. A disadvantage of this integrator resides in the fact that the transfer of charges from register A into capacitors $C^1, C^2, \ldots C^N$ can only be carried out when all the capacitors $C^1, C^2, \ldots C^N$ have been read. Consequently, the reading time of the whole of the capacitors must be less than $T_A$.

FIG. 4 shows a preferred embodiment of the present invention. In this embodiment, the input demultiplexer is identical to that of the integrator in FIG. 3. Consequently, it will not be described again. The integrator of FIG. 4 differs from the integrator shown in FIG. 3 by the fact that the output multiplexer is also formed by a shift register B with charge transfer of CCD type. This shift register with parallel inputs and a series output comprises N transfer stages each introducing the same delay $\tau_B$ which is given by the period of the potential applied to the electrodes providing the charge transfer. As explained in more detail hereafter the delay $\tau_B$ is very often different from the delay $\tau_A$. Each input of register B is connected to one of the capacitors $C^1, C^2, \ldots C^N$ through a passage gate, not shown. The output of register B is connected to a charge-voltage conversion stage 11 having a capacity $C_S$. Furthermore, since the charge which may be transferred by a CCD register is limited, so as to be able to integrate a high charge amount, the storage means $C^1, C^2, \ldots C^N$ are each formed by two interconnected capacities $C_1^1, C_1^2, \ldots C_1^N$ and $C_2^1, C_2^2, C_2^N$ whose dimensions have been selected so as to send only a fraction $\alpha$ of the charge samples or packets $\Sigma_m Q_{n,m}$, as will be explained in greater detail hereafter.

With the integrator of FIG. 4, after integrating, for the time MTA, charge samples $Q_{IN} = \Sigma_m Q_{n,m}$ on each capacitor $C^1, C^2, \ldots C^N$, the whole of the samples $\alpha Q_{IN}$ are simultaneously transferred to the corresponding stages of the output shift register B. During the beginning of a new integration in capacitors $C^1, C^2, \ldots C^N$, the output register B transfers the charge samples or packets $\alpha \Sigma_m Q_{n,m}$ in series to the charge-voltage conversion stage which delivers a sampled output analog signal $\Sigma_m V_{n,m}$.

In this case, the gain of the system is given by the following equation $$\frac{\Sigma V_{n,m}}{V_{n,m}} = \alpha M \frac{C_e}{C_S}$$

Furthermore, since the integration time over the M sequences is $MT_A$, the duration of the output sequence must be:

$$T_B \leqq MT_A$$

Consequently, the elementary delays $\tau_B$ of the output register B must be:

$$\tau_B = T_B/N \leqq MT_A/N = M\tau_A.$$

It follows that the relative transfer frequency between the input and output registers must satisfy the following equation:

$$F_B \geqq (1/M)F_A$$

A detailed embodiment of a non recursive analog integrator of the type of integrator shown in FIG. 4 will now be described with reference to FIGS. 5 to 7. This integrator has been constructed in integrated form using the N MOS-CCD technology on a P type silicon substrate. It is obvious for a man skilled in the art that this integrator may be formed on other substrates such as an N type silicon substrate, gallium arsenide substrate or similar. Similarly, the integrator may be formed in an N zone provided in the P substrate so as to effect volume charge transfer. Preferably, the integrator is entirely integrated on a single chip and even several integrators, identical or not, may be integrated on the same chip. However, an integrator in accordance with the invention may be envisaged formed of several interconnected parts.

Figure 5:
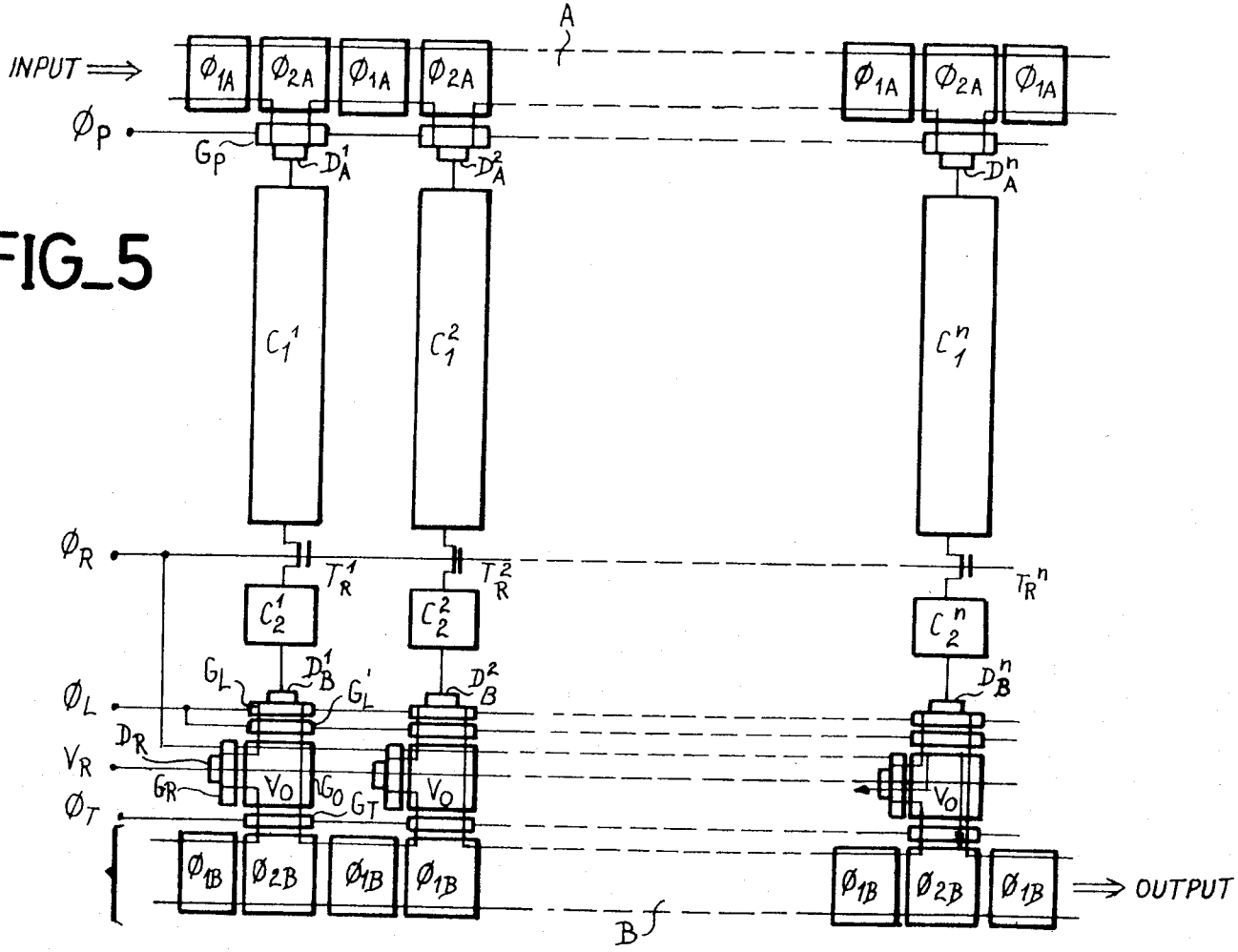
FIG. 5 is a top view of one embodiment of a non recursive analog integrator according to the present invention.

As shown in FIG. 5, the input demultiplexer is forme by a CCD type shift shift register A with two phase operation. In a way known per se, each stage of the register is formed by two electrode pairs each comprising a transfer electrode and a storage electrode. Each electrode pair is connected to an AC control potential $\phi_{1A}$ and $\phi_{2A}$ and in phase opposition. Furthermore, the storage electrode of the electrode pair controlled by $\phi_{2A}$ is used as output and it is referenced $G_A$ in FIG. 6*a*. The electrode $G_A$ of each stage of the shift register A is separated from the charge storage means by a passage gate $G_P$ connected to a potential $\phi_p$.

The storage means or integration sites comprise diodes $D_A^1, D_A^2, \ldots D_A^N$ formed in a way known per se by an N type diffusion when the substrate is of type P. Each diode $D_A^n$ is connected to a first capacitor $C_1^N$ formed by the substrate, an insulating layer, preferably silicon oxide and a gate, preferably made from aluminium or polycrystalline silicon. The first capacitors $C_1^1$, $C_1^2$, $C_1^N$ are interconnected by MOS transistors $T_R^1$, $T_R^2, \ldots T_R^1$ to second capacities $C_2^1, C_2^2, \ldots C_2^N$ formed like the first capacities. The gate of the MOS transistors $T_R^1$ is connected to a potential $\phi_R$ for disabling or enabling said transistors. The second capacitors $C_2^1, C_2^2, \ldots C_2^N$ are connected to diodes $D_B^1, D_B^2, D_B^N$ formed by an N type diffusion.

Diodes $D_B^n$ are connected to the inputs of the output multiplexer through a routing device. The routing device is formed for each storage means or integration site by two adjacent gates $G_L$, $G'_L$ controlled by the same potential $\phi_L$, $G'_L$ located on an extra thickness of oxide so as to obtain chargelss channel potentials in stages under $G_L$ and $G'_L$, by an intermediate passage gate $G_O$ connected to a fixed potential $V_O$, by two transfer gates $G_T$ and $G_R$ provided on two sides of gate $G_O$ and separating gates $G_O$ respectively from the multiplexer B and a discharge drain $D_R$ formed by an N type diffusion. Gate $G_T$ is connected to a potential $\phi_T$, gate $G_R$ to a potential $\phi_R$.

The output multiplexer B is fored by a two phase CCD type charge transfer shift register. This register has a structure identical to that of register A.

It is controlled by phase opposition control potentials $\phi_{1B}$ and $\phi_{2B}$. Furthermore, the storage electrode of the electrode pair controlled by $\phi_{2B}$ is used as input. It is referenced $G_B$ in FIG. 6*a*.

The operation of the non recursive analog integrator shown in FIG. 5 will now be described with reference more particularly to FIGS. 6*b* to 6*e* and FIGS. 7*a* and 7*b*.

FIG. 7*a* shows the diagram with respect to time of the potentials $\phi_{2A}$, $\phi_P$, $\phi_R$, $\phi_L$, $\phi_T$ and $\phi_{2B}$ applied to the different gates of the integrator during an integration cycle, i.e. during a time MTA. It can be seen, that, after each time TA, there is a transfer of charges from register A to the storage capacitors. At the end of the total integration time, i.e. the time MTA, there is transfer to the shift register B. P FIG. 7*b* shows on a large scale the diagram with respect to time of potentials $\phi_P$, $\phi_R$, $\phi_L$, and $\phi_T$. This diagram corresponds to the part surrounded by a dot-dash line in FIG. 7*a*. Thus, reference will be made more particularly to FIGS. 6*a* to 6*e* and FIG. 7*b* for explaining the operation of the integrator.

Thus, during time $t_1$, when each sequence m has been entirely introduced into the CCD register A and when the samples of rank n are on the storage electrodes $G_A$ at the level of the storage capacitors of the same rank, potential $\phi_P$ passes to the high level. As shown in FIG. 6*b*, the charge $Q_{n,m}$ under $G_A$ is transferred to the storage means and is divided between capacitors $C_1^n$ and $C_2^n$ interconnected by the transistor $T_R^n$ working as a triode, for the potential $\phi_R$ is at the high level.

The sum of the charges arriving successively after M input sequences on the capacitors $C_1^n$ and $C_2^n$ is accompanied by a potential variation $\Delta V_n$ from an initial potential $V_{\phi n}$ defined hereafter.

At the end of integration, we have $$\Delta V_n = \Sigma_m Q_{n,m}/(C_1^n + C_2^n) \quad (1)$$

with $\Delta V_n = V_{DB}(t_1) - V_{\phi n}$.

During time $t_2$, with potential $\phi_P$ having come back to a low level so as to allow the input of a new sequence into register A, potential $\phi_R$ passes to a low level. Simultaneously, the transistor $T_R^n$ is disabled isolating capacitor $C_2^n$ from capacitor $C_1^n$, whereas gate $G_R$ passes to a low potential isolating the channel under gate $G_O$ from drain $D_R$.

Then, simultaneously or not, the potentials $\phi_L$ and $\phi_T$ pass to the high level. Gate $G_L$ defines a chargeless channel potential corresponding to the reference potential $V_{\phi n}$ and gate $G_T$ allows charges to pass from capacitor $C_2^n$ to the corresponding stage $G_B$ of the output register B. For that, the high level potentials under $G_L$, $G_O$, $C_T$ and $G_B$ must be such that $$V_{\phi n} = \phi_{LS} < V_{OS} < \phi_{TS} < \phi_{2BS}$$

$V_{OS}$, $\phi_L$, $\phi_{TS}$, $\phi_{BS}$ being the chargeless channel potentials under gates $G_L$, $G_O$, $G_T$ and $G_B$.

The charges stored on the electrode of capacity $C_2^n$, are transferred to the CCD channel of register B as shown in FIG. 6*c*.

The charges transferred to register B correspond to the equation $$Q_{Ln} = [V_{DB}(t_1) - V_{\phi n}]C_2^n \quad (2)$$

with $V_{DB}(t_1) = V_{DA}(t_1) = V_D$.

During time $t_3$, the potential $\phi_T$ applied to gate $G_T$ passes to the low level isolating the output register B from the passage gate $G_O$.

Then, potential $\phi_R$ passes to the high level simultaneously interconnecting the two capacitors $C_1^n$ and $C_2^n$ and bringing the channel under gate $G_R$ to a high level so as to interconnect the capacitors with the charge removal drain $D_R$.

In fact, since the high level potentials under $G_R$, $G_O$ and $G_L$ are chosen so that $$V_{\phi n} = \phi_{LS} < V_{OS} < \phi_{RS}$$

a charge amount present under capacitor $C_1^n$ is discharged to drain $D_R$ as shown in FIG. 6d. This charge amount corresponds to $$Q_{En}=[V_{DB}(t_1)-V_{\phi n}]C_1^n \quad (3)$$

When this charge is removed, the potential of capacitors $C_1^n$ and $C_2^n$ is defined by the potential of the chargeless channel $V_{\phi n}$ under gate $G_L$ so that $$V_{\phi n}=\phi_{Lhigh}-V_{Tn}$$

This reference potential $V_{\phi n}$ is a function of the threshold $V_{Tn}$ of the induced MOS with gate $G_{Ln}$.

In fact, a dispersion of the thresholds $V_{Tn}$ between stages n does not modify the charge ratio $Q_{Ln}/\Sigma_m Q_{n,m}$.

In fact, for the same stage, $V_{\phi n}$ is the same at times $t_2$ and $t_3$, for it is defined by the same induced MOS with gate $G_L$.

Starting from the equations (1), (2), and (3), we have:

$$\Sigma_m Q_{n,m}=(V_D V_{\phi n})(C_1^n+C_2^n)$$

$$Q_{Ln}=(V_D-V_{\phi n})C_2^n$$

$$Q_{En}=(V_D-V_{\phi n})C_1^n$$

The charge removed to the output register is then $$Q_{Ln}=\alpha\Sigma_m Q_{n,m}$$

with $$\alpha=\frac{C_2^n}{C_1^n+C_2^n}$$

The charge eliminated by drain $D_R$ is therefore:

$$Q_{En}=(1-\alpha)_m Q_{n,m}$$

During time $t_4$, the potential $\phi_L$ passes to the low level, separating capacitors $C_1^n$ and $C_2^n$ from the routing system. As shown in FIG. 6e, the potential of capacitors $C_1^n$ and $C_2^n$ is at $V_{\phi n}$. The system is ready to perform the following integration.

Furthermore, the heat charges generated under the passage gate $G_O$ are discharged to drain $D_R$ during the whole time of integration of the charges on $C_1^n$ and $C_2^n$ since $\phi_R$ remains at the high level.

With the above described integrator, the time for splitting up and transferring the charges to the output register may be relatively long with respect to the input sampling period. It may last for the whole time of an input sequence.

Similarly, as already mentioned with reference to FIG. 4, the output sampling frequency may be M times smaller than that at the input with M=number of integrated sequences.

In addition, the integrator may have a high integration time, for the heat generation at the integration sites is small and due solely to the leak current of diodes $D_A$ and $D_B$.

It is also possible to connect several integrators of the above type in parallel together with multiplexing at the inputs and outputs. That allows the maximum operating frequency to be multiplied by $p(p\geqq 2)$, while multiplying by p the number of resolution points of each sequence.

It is obvious for a man skilled in the art that numerous modifications may be made to the above described integrators without departing from the scope and spirit of the present invention. For example, the CCD registers may have four control phases and not two.

What is claimed is:

1. A non-recursive analog integrator for M integrations of a sampled analog signal including M repetitive sequences each of N samples in the form of charge packets comprising a serial-input parallel-output input demultiplexer having N outputs, and an input supplied with the signal, N capacitor storage means each including an electrode connected to have a floating potential with respect to a reference potential, and a parallel-input serial-output multiplexer having N inputs and an output, the capacitor storage means being connected in parallel with a separate capacitor storage means connected to each output of the demultiplexer and the respective input of the multiplexer, each capacitor storage means performing at successive integrations a summation of the charge packets of a sample of correponding rank of the signal so that at the end of the M integrations an integrated analog signal is available at the output of the multiplexer.

2. The integrator of claim 1 wherein the input demultiplexer is a charge-transfer device with a serial input connected to voltage-charge conversion means and N outputs each of which is connected to the input of its separate capacitor storage means by switching means which are periodically closed after each sequence has been inputted.

3. The integrator of claim 2 wherein the output multiplexer is a charge-transfer device having N parallel inputs and a serial output and each input is connected to the output of its separate capacitor storage means by switching means which are periodically closed after M sequences of integrations.

4. The integrator of claim 1 wherein the multiplexer is formed by a plurality of analog gates connected respectively between each capacitor and a reading stage, said gates being controlled by timing impulses.

5. The integrator of claim 1 in which each capacitor storage means includes a pair of MOS capacitor portions interconnected by way of an MOS transistor.

6. The integrator of claim 5 in which each capacitor storage means further includes a diode which is connected between the second capacitor and the input of the multiplexer.

7. The integrator of claim 6 in which a routing means is connected between the diode and the input of the multiplexer.

8. The integrator of claim 7 which further includes a discharge drain connected to the routing means and the routing means is adapted to send the output of the capacitor storage means selectively either to the discharge drain or to the input of the multiplexer.

9. The integrator of claim 8 wherein said routing means is separated from the output of the diode by first gating, means from the input to the discharge drain by second gating means, and from the input to the multiplexer by third gating means, the potentials of each of said gating means being controllable.

10. The integrator of claim 9 wherein the routing means comprises a gating means maintained at a fixed potential.

11. The integrator of claim 10 in which the potential of the first gating means is periodically brought to the reference potential associated with the electrode of each electrode.

12. The integrator of claim 1 wherein the multiplexer is a charge transfer shift register having a first transfer frequency FA and the demultiplexer is a charge transfer shift register having a second lower transfer frequency $F_B$, and $F_B\geqq(1/M)\ F_A$.

* * * * *